US005976743A

United States Patent [19]

Yamaki et al.

[11] Patent Number: 5,976,743

[45] Date of Patent: Nov. 2, 1999

[54] ELECTROPHOTOGRAPHIC PHOTORECEPTOR

[75] Inventors: Takeyuki Yamaki; Minoru Inoue, both of Osaka, Japan

[73] Assignee: Matsushita Electric Works, Ltd., Osaka, Japan

[21] Appl. No.: 09/014,581

[22] Filed: Jan. 28, 1998

[30] Foreign Application Priority Data

Jan. 28, 1997 [JP] Japan ..... 9-014360

[51] Int. Cl.[6] ..... G03G 5/047

[52] U.S. Cl. ..... 430/58.2

[58] Field of Search ..... 430/59, 58, 66, 430/67

[56] References Cited

U.S. PATENT DOCUMENTS

| | | | |
|---|---|---|---|
| 5,082,737 | 1/1992 | Bobrich et al. | 428/425.9 |
| 5,436,099 | 7/1995 | Schank et al. | 430/59 |
| 5,824,443 | 10/1998 | Kushibiki et al. | 430/59 |

FOREIGN PATENT DOCUMENTS

| | | |
|---|---|---|
| 59-010951 | 1/1984 | Japan . |
| 61-238062 | 10/1986 | Japan . |
| 63-136050 | 6/1988 | Japan . |
| 2-168259 | 6/1990 | Japan . |
| 2163971 | 3/1986 | United Kingdom . |
| 85-00901 | 2/1985 | WIPO . |

*Primary Examiner*—John Goodrow
*Attorney, Agent, or Firm*—Sughrue, Mion, Zinn, Macpeak & Seas, PLLC

[57] ABSTRACT

An electrophotographic photoreceptor having a charge transporting layer excellent in the abrasion resistance, stain resistance (toner releasability) and corona resistance, having a long life and also having excellent processability. An electrophotographic photoreceptor comprising a conductive substrate having thereon a charge generating layer containing a photoconductive material in a transparent resin cured product and at least one charge transporting layer containing a charge transporting material in a transparent resin cured product in this order, wherein the transparent resin cured product in the outermost layer of said at least one charge transporting layer is a cured product of silicone resin and contains a linear polysiloxanediol in an amount of 1 to 100 parts per 100 parts by weight of all silicone solids contents exclusive of the polysiloxanediol.

8 Claims, 1 Drawing Sheet

ELECTROPHOTOGRAPHIC PHOTORECEPTOR

FIELD OF THE INVENTION

The present invention relates to an electrophotographic photoreceptor for use in the photosensitive part of a dry electrophotographic copying machine, a dry electrophotographic printer or the like.

BACKGROUND OF THE INVENTION

According to the dry electrophotographic process in general, the printing or copying is performed in such a manner that an image is electrophotographically formed on a photosensitive drum, the electrophotographic image is transferred to a transfer paper and a thermoplastic resin powder (hereinafter referred to as a toner) containing a pigment having a charge opposite to the charge constituting the electrophotographic image is attached to the electrophotographic image part on the transfer paper to fix the image as a visible image.

Conventionally, inorganic photoconductive materials such as selenium, zinc oxide and cadmium sulfide are used as the electrophotographic photoreceptor, however, these are not necessarily satisfied with respect to the properties such as thermal stability, durability, processability and flexibility. In recent years, accordingly, organic photoconductive materials are prevailing. In particular, a function separated photoreceptor comprising a charge generating layer containing an organic photoconductive material in a transparent organic resin cured product and a charge transporting layer containing a charge transporting material in a transparent organic resin cured product, which are laminated in this order, is mainly used. The shape of the photoreceptor includes sheet, belt and drum, however, a predominant photosensitive drum comprises a cylindrical drum core made of a conductive material such as a metal, having laminated on the circumferential surface thereof a charge generating layer and a charge transporting layer in this order.

The charge generating layer and the charge transporting layer both are required to have a high performance with respect to the transparency, the electric charge holding effect and electrostatic charge acceptability in a dark place, and the like. In particular, the charge transporting layer is an outermost surface of the photoreceptor and therefore, is further required to have excellent properties such as high abrasion resistance, high stain resistance (toner releasability) and corona resistance.

In order to remove toner not transferred to the transfer paper but remaining on the surface of the photoreceptor, a cleaning blade or brush is usually put into contact with the surface of the photoreceptor. If the surface of the charge transporting layer is inferior in the abrasion resistance, due to sliding in contact with the cleaning blade or brush, the surface of the charge transporting layer is readily roughened or wears to cause deterioration of the properties.

In the case where a corona discharge device is used for charging the photoreceptor, ozone is generated due to the corona discharge. The ozone destroys the bonding of the organic resin in the charge transporting layer of an organic transparent cured product and accordingly, the surface of the charge transporting layer is readily roughened to cause deterioration of the properties.

If the surface of the charge transporting layer is roughened due to abrasion and/or corona discharge, the effect of cleaning the residual toner is naturally reduced and the photosensitive properties are deteriorated, which adversely affects the image. Thus, if the surface of the charge transporting layer is liable to be roughened, it gives rise to the reduction in the number of sheets printable by one photoreceptor, namely, the press life.

In recent years, taking account of transparency and abrasion resistance, a special acrylic resin or special polycarbonate resin is being used as the transparent organic resin cured product of a charge transporting layer in many cases, however, these are still not yet satisfied with respect to the capabilities such as abrasion resistance, stain resistance or corona resistance.

As the method for reducing the abrasion loss on the surface of the photoreceptor, a large number of proposals have been made for peripherals of the photoreceptor, such as cleaning blade or toner. JP-A-57-128376 (the term "JP-A" as used herein means an "unexamined published Japanese patent application") proposes a method for reducing the abrasion loss of the photosensitive drum surface by fixing a silicone oil to the surface of the cleaning blade to thereby reduce the coefficient of friction between the photosensitive drum surface and the cleaning blade, however, the silicone oil fixed is not retained and the durability cannot be improved as expected. JP-A-4-16855 proposes a method for reducing the abrasion loss of the photosensitive drum by mixing a thermoplastic fluororesin into the toner to thereby reduce the frictional resistance between the photosensitive drum surface and the cleaning blade, however, the cost of toner is increased and the range of the fixing conditions is disadvantageously narrowed.

For improving the durability of the photoreceptor surface from the material side, a method of applying a silicone resin coating as the surface protective layer has been proposed. JP-A-2-148043 proposes a method for improving the durability of the photoreceptor by forming a cured product of a silicone resin coating containing an organic acid and/or an inorganic acid, as the protective layer on the photosensitive layer. The silicone resin has properties such that as compared with the organic resin, the cured coating thereof has high hardness, is improved in the abrasion resistance and is difficult of erosion by ozone generated on the corona discharge. This silicone resin is a hydrolysate of alkoxysilane and necessary to be heated for the curing even if a curing catalyst is used in combination. In the Example of this patent publication, 1 hour was spent for the curing at 100° C. and thus, the silicone resin is deficient in that the processability is inferior. JP-A-6-11853 proposes a method of using a cured product of a coating material mainly comprising silica for the charge generating layer to impart abrasion resistance to the surface of the layer and providing the charge generating layer on the outermost circumference of the photosensitive drum. When the outermost circumference is a charge generating layer, advantageous effects result such that the photoreceptor surface is electrified to the positive charge and the problem of the generation of ozone can be evaded. However, for forming a cured product having sufficiently high abrasion resistance from the coating material mainly comprising silica, heat treatment at 200° C. or higher is usually necessary and this may impair the properties of the photoconductive material. In the Example of this patent publication, a cured product was formed by the heat treatment at 80° C., however, the reason why the low-temperature curing was achieved is not described. Further, the cured product obtained does not have toughness and is disadvantageous in that cracks are readily generated. JP-A-2-148043 and JP-A-6-11853 both have an object of improving the abrasion resistance and the corona resistance by forming a silicone resin or silica harder than the organic material on the outermost circumference of the photoreceptor, however, the stain resistance against residual toner (releasability) is not taken into consideration in these patent publications.

SUMMARY OF THE INVENTION

Accordingly, an object of the present invention is to provide an electrophotographic photoreceptor having a charge transporting layer excellent in the abrasion resistance, stain resistance and corona resistance, having a long life and also having excellent processability.

The present invention is to provide an electrophotographic photoreceptor comprising a conductive substrate having thereon a charge generating layer containing a photoconductive material in a transparent resin cured product and at least one charge transporting layer containing a charge transporting material in a transparent resin cured product in this order, wherein the transparent resin cured product in the outermost layer (i.e., the layer furthermost from the conductive substrate) of said at least one charge transporting layer is a cured product of silicone resin and contains a linear polysiloxanediol (A) represented by the following general formula (I):

$$HO(R^1{}_2SiO)_nH \quad (I)$$

wherein $R^1$ represents a monovalent hydrocarbon group and the $R^1$ groups may be the same or different, and n is an integer of 3 or more, in an amount of 1 to 100 parts per 100 parts by weight of all silicone solids contents exclusive of component (A).

The silicone resin is preferably silicone resin (1) or (2).

Silicone resin (1) further contains the following component (B):

Component (B):

an organosiloxane (hereinafter sometimes referred to as "organosiloxane (B)") as a hydrolytic polycondensate of a hydrolyzable mixture containing from 20 to 200 parts by weight of ($B_2$) a silicon compound represented by the formula: $Si(OR^2)_4$, and/or colloidal silica, per 100 parts by weight of ($B_1$) a silicon compound represented by the formula: $R^3Si(OR^2)_3$ (wherein $R^2$ and $R^3$ each represents a monovalent hydrocarbon group), the hydrolytic polycondensate being adjusted to have a weight-average molecular weight of 800 or more in terms of polystyrene.

The hydrolyzable mixture preferably further contains 60 parts by weight or less of ($B_3$) a silicon compound represented by the formula: $R^3{}_2Si(OR^2)_2$, per 100 parts by weight of ($B_1$).

Silicone resin (2) contains the following components (C), (D) and (E) in a blending ratio such that component (C) is from 1 to 99 parts by weight, component (D) is from 1 to 99 parts by weight and component (E) is from 0.0001 to 10 parts by weight, per 100 parts by weight in total of components (C) and (D):

Component (C):

a silica dispersed oligomer solution of organosilane (hereinafter sometimes referred to as "silica dispersed oligomer solution (C)") obtained by partially hydrolyzing a hydrolyzable organosilane represented by the formula:

$$R^4{}_mSiX_{4-m} \quad (II)$$

(wherein $R^4$ represents a substituted or unsubstituted monovalent hydrocarbon group having from 1 to 8 carbon atoms and the $R^4$ groups may be the same or different, m represents an integer of from 0 to 3, and X represents a hydrolyzable group) in colloidal silica dispersed in an organic solvent, water or a mixed solvent thereof under the condition of using from 0.001 to 0.5 mol of water per 1 molar equivalent of the hydrolyzable group (X);

Component (D):

a polyorganosiloxane (hereinafter sometimes referred to as "polyorganosiloxane (D)") represented by the average composition formula:

$$R^5{}_aSi(OH)_bO_{(4-a-b)/2} \quad (III)$$

(wherein $R^5$ represents a substituted or unsubstituted monovalent hydrocarbon group having from 1 to 8 carbon atoms and the $R^5$ groups may be the same or different, a and b each represents a number satisfying the relations of $0.2 \leqq a < 2$, $0.0001 \leqq b \leqq 3$ and $a+b<4$) and containing a silanol group in the molecule; and Component (E):

a curing catalyst (hereinafter sometimes referred to as "curing catalyst (E)").

In formula (I) of the linear polysiloxanediol (A) in the present invention, n is preferably in the range of $10 \leqq n \leqq 50$.

The silicone resin for use in the present invention preferably further contains the following component (F) in a blending ratio of from 1 to 100 parts by weight per 100 parts by weight of all silicone solid contents exclusive of component (A)) (this also applies to silicone resins (1) and (2) described above as preferred examples of the silicone resin):

Component (F):

a monomer represented by the formula:

$$CH_2{=}CR^6(COOR^7) \quad (IV)$$

(wherein $R^6$ represents a hydrogen atom and/or a methyl group), which is an acrylic resin as a copolymer of:

a first (meth)acrylic ester where $R^7$ is a substituted or unsubstituted monovalent hydrocarbon group having from 1 to 9 carbon atoms;

a second (meth)acrylic ester where $R^7$ is at least one group selected from the group consisting of an epoxy group, a glycidyl group and a hydrocarbon group containing at least either one of these; and a third (meth)acrylic ester where $R^7$ is a hydrocarbon group containing an alkoxysilyl group and/or a halogenated silyl group.

The term "(meth)acrylic ester" as used herein means either one or both of acrylic ester and methacrylic ester.

Between the charge generating layer and the charge transporting layer, at least one intermediate coat layer comprising a transparent resin cured product is preferably further laminated.

Further, the electrophotographic photoreceptor of the present invention may further comprise at least one intermediate layer comprising a transparent resin cured product between a plurality of the charge transporting layers.

DETAILED DESCRIPTION OF THE INVENTION

Figure 1:
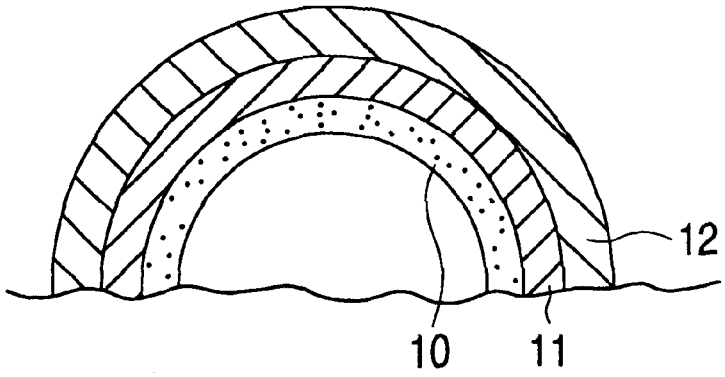
FIG. 1 is a cross-sectional view showing an embodiment of an electrophotographic photoreceptor according to the present invention.

The "linear polysiloxanediol" as component (A) for use in the present invention can render the surface of the cured coating of the silicone resin containing the component, which will be described later, water repellent, impart excellent residual toner releasability to the coating and reduce the coefficient of friction between the cleaning blade and the conductive substrate surface to thereby lowers the abrasion loss of the photoreceptor. (Of course, by using the silicone resin as a binder, the surface hardness increases and at least due to this, the abrasion resistance is improved.)

$R^1$ in formula (I) for linear polysiloxanediol (A) is not particularly limited as long as it is a monovalent hydrocarbon group, and includes, for example, a substituted or unsubstituted hydrocarbon group having from 1 to 8 carbon atoms. Specific examples thereof include an alkyl group such as methyl, ethyl, propyl, butyl, pentyl, hexyl, heptyl and octyl; a cycloalkyl group such as cyclopentyl and cyclohexyl; an aralkyl group such as 2-phenylethyl, 2-phenylpropyl and 3-phenylpropyl; an aryl group such as phenyl and tolyl; an alkenyl group such as vinyl and allyl; a halogen-substituted hydrocarbon group such as chloromethyl, γ-chloropropyl and 3,3,3-trifluoropropyl; and a substituted hydrocarbon group such as γ-methacryloxypropyl, γ-glycidoxypropyl, 3,4-epoxycyclohexylethyl and γ-mercaptopropyl. Of these, an alkyl group having from 1 to 4 carbon atoms and a phenyl group are preferred because these can be easily synthesized and are readily available.

Of the linear polysiloxanediols having such an $R^1$ group, dimethylsiloxanediol and methylphenylsiloxanediol are preferred so as to impart more excellent toner releasability to the cured coating of the coating material composition containing the silicone resin, which will be described later.

Linear polysiloxanediol (A) does not have a reactive group other than the terminal OH group and is a relatively poorly reactive molecule. Accordingly, linear polysiloxanediol (A) blended in the silicone resin cannot exhibit complete compatibility in the coating material composition containing the silicone resin, which will be described later, and is dispersed as an ultrafine particle. Due to this, linear polysiloxanediol (A) is easily coordinated on the surface of the coating of the coating material composition and forms a monomolecule layer, however, it is finally fixed to the surface of the coating because the silanol group as the terminal reactive group makes condensation reaction with the bulk resin. As a result, the siloxane bond is localized on the surface of the cured coating at a high density to thereby impart excellent toner releasability to the cured coating over a long period of time. When n in formula (I) is relatively small, superior compatibility is exhibited and accordingly, the linear polysiloxanediol (A) not only forms a layer on the surface of the coating but also is taken into the bulk to thereby impart elasticity and toughness to the cured coating, which in turn improves the adaptability of the cured coating for the deformation of the photoreceptor and effectively prevents cracks.

In formula (I), n is preferably within the range of $10 \leqq n \leqq 50$, more preferably $20 \leqq n \leqq 40$. If n is less than 10, the effect of improving the toner releasability may be reduced, whereas if n exceeds 50, linear polysiloxanediol (A) is weak in the relative bonding strength to the bulk coating and cannot be fixed on the surface of the cured coating over a long period of time and accordingly, the toner releasability tends to be lost with the passing of time.

The blending ratio of linear polysiloxanediol (A) in the silicone resin is not particularly limited, however, for example, linear polysiloxanediol (A) is blended in a ratio of from 1 to 100 parts by weight (preferably from 5 to 80 parts by weight) per 100 parts by weight of all silicone solid contents exclusive of linear polysiloxanediol (A). When the amount of (A) blended is less than 1 part by weight, the toner releasability tends to be weak, whereas if it exceeds 100 parts by weight, curing inhibition of the coating is liable to occur.

The silicone resin is used as a binder resin at least for the charge transporting material out of the photoconductive material in the charge generating layer and the charge transporting material in the charge transporting layer, and at the same time, as a layer forming component at least of the charge transporting layer out of the charge generating layer and the charge transporting layer.

The silicon unit of the silicone includes monofunctional, bifunctional, trifunctional and tetrafunctional silicon units represented by the following formulae:

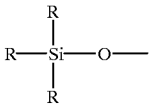

monofunctional

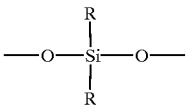

bifunctional

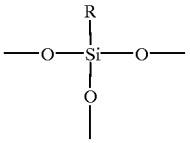

trifunctional

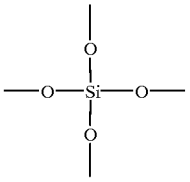

tetrafunctional (wherein the R groups, which may be the same or different, each represents a monovalent organic group). Of these silicon units, the silicone resin for use in the present invention contains either one or both of the trifunctional silicon unit and the tetrafunctional silicon unit in a ratio by number of preferably 30% or more, more preferably 35% or more, still more preferably 40% or more (when the silicone resin contains both trifunctional and tetrafunctional silicon units, the total number of these) based on the total number of all silicon units. If this ratio by number is less than 30%, the cured coating of the coating material composition containing the silicone resin, which will be described later, tends to have low cross-linking density, insufficient layer strength and deficient abrasion resistance.

The silicone resin containing component (A) for use in the present invention is preferably silicone resin (1) further containing component (B) in view of the transparency and the abrasion resistance, and it is preferably silicone resin (2) further containing components (C), (D) and (E) in view of the transparency, the abrasion resistance and the room temperature (ordinary temperature) curability.

The starting material used for component (B) contained in silicone resin (1), namely for organosiloxane (B), is a hydrolyzable mixture containing silicon compounds ($B_1$) and ($B_2$), however, this hydrolyzable mixture preferably further contains silicon compound ($B_3$) for the purpose of imparting toughness to the cured coating of the coating material composition containing the silicone resin, which will be described later.

Silicon compounds ($B_1$) to ($B_3$) can be generally represented by the formula:

$$R^3_pSi(OR^2)_{4-p} \quad (V)$$

(wherein $R^2$ and $R^3$ each represents a monovalent hydrocarbon group and p represents an integer of from 0 to 2).

$R^3$ is not particularly limited and includes, for example, a substituted or unsubstituted hydrocarbon group having from 1 to 8 carbon atoms. Specific examples thereof include an alkyl group such as methyl, ethyl, propyl, butyl, pentyl, hexyl, heptyl and octyl; a cycloalkyl group such as cyclopentyl and cyclohexyl; an aralkyl group such as 2-phenylethyl, 2-phenylpropyl and 3-phenylpropyl; an aryl group such as phenyl and tolyl; an alkenyl group such as vinyl and allyl; a halogen-substituted hydrocarbon group such as chloromethyl, γ-chloropropyl and 3,3,3-trifluoropropyl; and a substituted hydrocarbon group such as γ-methacryloxypropyl, γ-glycidoxypropyl, 3,4-epoxycyclohexylethyl and γ-mercaptopropyl. Of these, an alkyl group having from 1 to 4 carbon atoms and a phenyl group are preferred because these can be easily synthesized and are readily available.

$R^2$ is not particularly limited and, for example, those containing an alkyl group having from 1 to 4 carbon atoms as the main raw material may be used.

Examples of the tetraalkoxysilane where p is 0 include tetramethoxysilane and tetraethoxysilane; examples of the organotrialkoxysilane where p is 1 include methyltrimethoxysilane, methyltriethoxysilane, methyltriisopropoxysilane, phenyltrimethoxysilane, phenyltriethoxysilane and 3,3,3-trifluoropropyltrimethoxysilane; and examples of the diorganodialkoxysilane where p is 2 include dimethyldimethoxysilane, dimethyldiethoxysilane, diphenyldimethoxysilane, diphenyldiethoxysilane and methylphenyldimethoxysilane.

The $R^2$ or $R^3$ groups may be the same or different among the silicon compounds ($B_1$) to ($B_3$).

Organosiloxane (B) can be prepared, for example, by diluting the hydrolyzable mixture with an appropriate solvent, adding water as a curing agent and a catalyst thereto each in a necessary amount, and effecting hydrolysis and polycondensation reaction to prepolymerize the mixture. The reaction is controlled so that the prepolymer obtained can have a weight-average molecular weight (Mw) in terms of polystyrene, of 800 or more, preferably 850 or more, more preferably 900 or more. If the prepolymer has a molecular weight distribution (weight-average molecular weight (Mw)) of less than 800, great curing shrinkage takes place at the polycondensation of silicone resin (1) and the coating of the coating material composition containing the silicone resin, which will be described later, may easily undergo generation of cracks.

The amounts of raw materials ($B_1$) and ($B_2$) used in the preparation of organosiloxane (B) are such that ($B_2$) is from 20 to 200 parts by weight (preferably from 40 to 160 parts by weight, more preferably from 60 to 120 parts by weight), per 100 parts by weight of ($B_1$). If the amount of ($B_2$) used is less than the above-described range, the cured coating of the coating material composition containing the silicone resin, which will be described later, cannot have a desired hardness (is reduced in the hardness), whereas if it exceeds the above-described range, the cured coating is excessively increased in the cross-linking density to have too much high hardness and accordingly, disadvantageously readily undergoes generation of cracks.

In the case when the raw material ($B_3$) is further used if desired, the amounts of ($B_1$) to ($B_3$) used are such that ($B_2$) is from 20 to 200 parts by weight (preferably from 40 to 160 parts by weight, more preferably from 60 to 120 parts by weight) and ($B_3$) is 60 parts by weight or less (preferably 40 parts by weight or less, more preferably 30 parts by weight or less), per 100 parts by weight of ($B_1$). If the amount of ($B_2$) used is less than the above-described range or the amount of ($B_3$) used exceeds the above-described range, the cured coating cannot have a desired hardness (is reduced in the hardness), whereas if the amount of ($B_2$) used exceeds the above-described range, the cured coating is excessively increased in the cross-linking density to have too much high hardness and accordingly, disadvantageously readily undergoes generation of cracks.

The colloidal silica which can be used as the raw material ($B_2$) is not particularly limited, however, for example, a water-dispersible colloidal silica or a non-aqueous colloidal silica dispersible in an organic solvent such as alcohol may be used. In general, such a colloidal silica contains from 20 to 50 wt % of silica as a solid content and from this value, the blending amount of silica can be determined. When a water-dispersible colloidal silica is used, water present as a component other than the solid contents can be used as a curing agent, as described later. The water-dispersible colloidal silica is usually produced from water glass, however, it is easily available on the market. The organic solvent-dispersible colloidal silica can be easily prepared by displacing water of the water-dispersible colloidal silica by an organic solvent. The organic solvent-dispersible colloidal silica is easily available on the market similarly to the water-dispersible colloidal silica. In the case of an organic solvent-dispersible colloidal silica, as the organic solvent in which colloidal silica is dispersed, one or more selected from the group consisting of lower aliphatic alcohols such as methanol, ethanol, isopropanol, n-butanol and isobutanol; ethylene glycol derivatives such as ethylene glycol, ethylene glycol monobutyl ether and acetic ethylene glycol monoethyl ether; diethylene glycol derivatives such as diethylene glycol and diethylene glycol monobutyl ether; and diacetone alcohols, may be used. In combination with this hydrophilic organic solvent, toluene, xylene, ethyl acetate, butyl acetate, methyl ethyl ketone, methyl isobutylene ketone or methyl ethyl ketoxime may also be used.

In the case where colloidal silica is used as the raw material ($B_2$), the above-described use ratio of ($B_2$) is a part by weight including the dispersion medium.

Water is used as the curing agent in the hydrolytic polycondensation reaction of the hydrolyzable mixture and the amount of water used is preferably from 0.01 to 3.0 mol, more preferably from 0.3 to 1.5 mol, per 1 molar equivalent of the $OR^2$ group contained in the hydrolyzable mixture.

As the diluting solvent for use in the hydrolytic polycondensation reaction of the hydrolyzable mixture, for example, one or more selected from the group consisting of lower aliphatic alcohols such as methanol, ethanol, isopropanol, n-butanol and isobutanol; ethylene glycol derivatives such as ethylene glycol, ethylene glycol monobutyl ether and acetic ethylene glycol monoethyl ether; diethylene glycol derivatives such as diethylene glycol and diethylene glycol monobutyl ether; and diacetone alcohols, may be used, similarly to the dispersion solvent of colloidal silica. In combination with this hydrophilic organic solvent, toluene, xylene, ethyl acetate, butyl acetate, methyl ethyl ketone, methyl isobutylene ketone or methyl ethyl ketoxime may also be used.

Organosiloxane (B) is preferably adjusted to have a pH of from 3.8 to 6. If the pH is within this range, organosiloxane (B) can be stably used within the above-described range of molecular weight. If the pH departs from this range, organosiloxane (B) is poor in the stability and the usable time from the preparation of the coating material composition containing the silicone resin, which will be described later, is limited. The method for adjusting the pH is not particularly limited, however, when the pH lowers less than 3.8 at the mixing of raw materials of organosiloxane (B), the pH may be adjusted to fall within the above-described range by using a basic reagent such as ammonia or when the pH exceeds 6, it may be adjusted by using an acidic reagent such as hydrochloric acid. Depending on the pH, the molecular weight may remain low but the reaction may not proceed and take a time to reach the above-described range of molecular weight. In such a case, organosiloxane (B) may be heated to accelerate the reaction or after reducing the pH with an acidic reagent to proceed the reaction, the pH may be returned to a predetermined value with a basic reagent.

Silicone resin (1) needs not contain a curing catalyst when it is cured by heating, however, it may further contain a curing agent, if desired, for the purpose of accelerating the condensation reaction of organosiloxane (B) to thereby accelerate the heat curing of the coating of the coating material composition of the silicone resin, which will be described later, or to cure the coating at ordinary temperature. The curing catalyst is not particularly limited and examples thereof include alkyl titanates; carboxylic acid metal salts such as tin octylate, dibutyltin dilaurate and dioctyltin dimaleate; amine salts such as dibutylamine-2-hexoate, dimethylamine acetate and ethanolamine acetate; carboxylic acid quaternary ammonium salts such as acetic tetramethylammonium; amines such as tetraethylpentamine; amine-base silane coupling agents such as N-β-aminoethyl-γ-aminopropyltrimethoxysilane and N-β-aminoethyl-γ-aminopropylmethyldimethoxysilane; acids such as p-toluenesulfonic acid, phthalic acid and hydrochloric acid; aluminum compounds such as aluminum alkoxide and aluminum chelate; alkali metal salts such as lithium acetate, potassium acetate, lithium formate, sodium formate, potassium phosphate and potassium hydroxide; titanium compounds such as tetraisopropyl titanate, tetrabutyl titanate and titanium tetraacetylacetonate; and halogenated silanes such as methyltrichlorosilane, dimethyldichlorosilane and trimethylmonochlorosilane. Other than these, any may be used if it is effective for the acceleration of the condensation reaction of organosiloxane (B).

In the case where silicone resin (1) contains also a curing catalyst, the amount of the curing catalyst is preferably 10 wt % or less, more preferably 8 wt % or less, based on organosiloxane (B). If the amount exceeds 10 wt %, the storage stability of the coating material composition containing the silicone resin may be impaired.

Component (C) contained in silicone resin (2), namely, silica dispersed oligomer solution (C), is a main component of the base polymer having a hydrolyzable group (X) as a functional group of undertaking the curing reaction in the formation of cured coating of the coating material composition containing silicone resin, which will be described later. This can be obtained, for example, by adding one or more hydrolyzable organosilanes represented by formula (II) to colloidal silica dispersed in an organic solvent or water (or a mixed solvent of an organic solvent and water), and partially hydrolyzing the hydrolyzable organosilane under the condition of using from 0.001 to 0.5 mol of water (water previously contained in the colloidal silica and/or water separately added) per 1 molar equivalent of the hydrolyzable group (X).

The $R^4$ groups in the hydrolyzable organosilane represented by formula (II) are no particularly limited as long as the groups, which may be the same or different, represent a substituted or unsubstituted monovalent hydrocarbon group having from 1 to 8 carbon atoms, and examples thereof include an alkyl group such as methyl, ethyl, propyl, butyl, pentyl, hexyl, heptyl and octyl; a cycloalkyl group such as cyclopentyl and cyclohexyl; an aralkyl group such as 2-phenylethyl, 2-phenylpropyl and 3-phenylpropyl; an aryl group such as phenyl and tolyl; an alkenyl group such as vinyl and allyl; a halogen-substituted hydrocarbon group such as chloromethyl, γ-chloropropyl and 3,3,3-trifluoropropyl; and a substituted hydrocarbon group such as γ-methacryloxypropyl, γ-glycidoxypropyl, 3,4-epoxycyclohexylethyl and γ-mercaptopropyl. Of these, an alkyl group having from 1 to 4 carbon atoms and a phenyl group are preferred because these can be easily synthesized and are readily available.

The hydrolyzable group X in formula (II) is not particularly limited, and examples thereof include an alkoxy group, an acetoxy group, an oxime group, an enoxy group, an amino group, an aminoxy group and an amido group. Of these, an alkoxy group is preferred because of easy availability and easiness in the preparation of silica dispersed oligomer solution (C).

Specific examples of the hydrolyzable organosilane include alkoxysilanes, acetoxysilanes, oxysilanes, enoxysilanes, aminosilanes, aminoxysilanes and amidosilanes, which may be mono-, di-, tri- or tetra-functional with m in formula (II) being 0, 1, 2, or 3, respectively. Of these, alkoxysilanes are preferred because of easy availability and easiness in the preparation of silica-dispersed oligomer solution (C).

Of alkoxysilanes, examples of the tetraalkoxysilane where m is 0 include tetramethoxysilane and tetraethoxysilane, examples of the organotrialkoxysilane where m is 1 include methyltrimethoxysilane, methyltriethoxysilane, methyltriisopropoxysilane, phenyltrimethoxysilane, phenyltriethoxysilane and 3,3,3-trifluoropropyltrimethoxysilane, examples of the diorganodialkoxysilane where m is 2 include dimethyldimethoxysilane, dimethyldiethoxysilane, diphenyldimethoxysilane, diphenyldiethoxysilane and methylphenyldimethoxysilane, and examples of the triorganoalkoxysilane where m is 3 include trimethylmethoxysilane, trimethylethoxysilane, trimethylisopropoxysilane and dimethylisobutylmethoxysilane. Organosilane compounds generally called a silane coupling agent is included in the alkoxysilanes.

In the hydrolyzable organosilanes represented by formula (II), trifunctional organosilanes where m is 1 are present in a proportion of 50 mol % or more, preferably 60 mol % or more, more preferably 70 mol % or more. If the proportion is less than 50 mol %, sufficiently high coating hardness cannot be obtained from the coating material composition containing the silicone resin, which will be described later, and also the coating material composition is liable to deteriorate in the dry hardness.

The colloidal silica in silica dispersed oligomer solution (C) has effects of increasing the hardness and improving the smoothness and crack resistance, of the coated and cured coating of the coating material composition containing the silicone resin, which will be described later. The colloidal silica is not particularly limited, however, for example, a water-dispersible colloidal silica or a non-aqueous colloidal silica dispersible in an organic solvent such as alcohol may be used. In general, such a colloidal silica contains from 20 to 50 wt % of silica as a solid content and from this value, the blending amount of silica can be determined. When a water-dispersible colloidal silica is used, water present as a component other than the solid contents can be used not only for the hydrolysis of the hydrolyzable organosilane but also as a curing agent of the coating material composition containing the silicone resin, which will be described later. The water-dispersible colloidal silica is usually produced from water glass, however, it is easily available on the market. The organic solvent-dispersible colloidal silica can be easily prepared by displacing water of the water-dispersible colloidal silica by an organic solvent. The organic solvent-dispersible colloidal silica is easily available on the market similarly to the water-dispersible colloidal silica. In the case of an organic solvent-dispersible colloidal silica, the kind of the organic solvent in which colloidal silica is dispersed is not particularly limited, however, for example, one or more selected from the group consisting of lower aliphatic alcohols such as methanol, ethanol, isopropanol, n-butanol and isobutanol; ethylene glycol derivatives such as ethylene glycol, ethylene glycol monobutyl ether and acetic ethylene glycol monoethyl ether; diethylene glycol derivatives such as diethylene glycol and diethylene glycol monobutyl ether; and diacetone alcohols, may be used. In combination with this hydrophilic organic solvent, toluene, xylene, ethyl acetate, butyl acetate, methyl ethyl ketone, methyl isobutylene ketone or methyl ethyl ketoxime may also be used.

The colloidal silica in silica-dispersed oligomer solution (C) has the above-described effect, however, if it is blended in excess, the cured coating of the coating material composition containing the silicone resin, which will be described later, becomes too high in the hardness and this may give rise to the generation of cracks on the coating. Accordingly, the colloidal silica is contained in silica-dispersed oligomer solution (C) in an amount, in terms of silica as a solid content, of preferably from 5 to 95 wt %, more preferably from 10 to 90 wt %, most preferably from 20 to 85 wt %. If the content is less than 5 wt %, the coating tends to fail in having a desired hardness, whereas if it exceeds 95 wt %, generation of cracks may be readily incurred.

In the preparation of silica-dispersed oligomer solution (C), water is used in an amount, as described above, of from 0.001 to 0.5 mol, preferably from 0.01 to 0.4 mol, per 1 molar equivalent of the hydrolyzable group (X) in the hydrolyzable organosilane. If the amount of water used is less than 0.001 mol, satisfactory partial hydrolysate cannot be obtained, whereas if it exceeds 0.5 mol, the partial hydrolysate becomes poor in the stability. Here, the amount of water used in the partial hydrolysis reaction of the hydrolyzable organosilane is, when water-free colloidal silica (for example, colloidal silica using only an organic solvent as the dispersion medium) is used, an amount of water separately added and when colloidal silica containing water (for example, colloidal silica using only water or a mixed solvent of an organic solvent and water as the dispersion medium) is used, at least the amount of water previously contained in the colloidal silica out of water previously contained in the colloidal silica and water separately added. In the case when water previously contained in the colloidal silica can satisfy by itself the amount of water specified above, water needs not be added separately. However, when water previously contained in the colloidal silica cannot satisfy by itself the amount of water specified above, water needs be separately added in an amount sufficiently large to reach the amount of water specified above and in this case, the above-described amount of water used is the total amount of water previously contained in colloidal silica and water separately added. Even when water previously contained in colloidal silica can satisfy by itself the amount of water specified above, water may be added separately and in this case, the amount of water used is also the total amount of water previously contained in colloidal silica and water separately added. Water is separately added so that this total amount does not exceed the upper limit of the amount of water specified above (0.5 mol per 1 molar equivalent of the hydrolyzable group (X)).

The method for partially hydrolyzing the hydrolyzable organosilane is not particularly limited and for example, hydrolyzable organosilane and colloidal silica may be mixed (in the case when the colloidal silica is completely free of water or does not contain a necessary amount of water, water is added here and blended). At this time, the partial hydrolysis reaction proceeds at ordinary temperature, however, in order to accelerate the partial hydrolysis reaction, the mixture may be heated (for example, at a temperature of from 60 to 100° C.) or a catalyst may be used. The catalyst is not particularly limited, however, for example, organic acids and inorganic acids, such as hydrochloric acid, acetic acid, halogenated silane, chloroacetic acid, citric acid, benzoic acid, dimethylmalonic acid, formic acid, propionic acid, glutaric acid, glycolic acid, maleic acid, malonic acid, toluenesulfonic acid and oxalic acid, may be used individually or in combination of two or more thereof.

Silica-dispersed oligomer solution (C) is preferably adjusted to have a pH of from 2.0 to 7.0, more preferably from 2.5 to 6.5, still more preferably from 3.0 to 6.0, so as to stably obtain its performance for a long period of time. If the pH is out of this range, component (C) is extremely reduced in the retention of performance particularly under the condition such that the amount of water used is 0.3 mol or more per 1 molar equivalent of the hydrolyzable group (X). In the case when the pH of component (B) is out of the above-described range, if it is in the acidic side, the pH may be adjusted by adding a basic reagent such as ammonia and ethylenediamine, and if it is in the basic side, the pH may be adjusted by using an acidic reagent such as hydrochloric acid, nitric acid and acetic acid. However, the adjustment method is not particularly limited.

Component (D) contained in silicone resin (2), namely, silanol group-containing polyorganosiloxane (D), is a cross-linking agent for causing condensation reaction with component (C) which is the base polymer having a hydrolyzable group as a functional group undertaking the curing reaction, to form three-dimensional cross-linking in the cured coating. This is a component having an effect of absorbing strain due to the curing shrinkage of component (C) and preventing generation of cracks.

In average composition formula (III) for silanol group-containing polyorganosiloxane (D), $R^5$ is not particularly limited and examples thereof include the same groups as described for $R^4$ in formula (II). $R^5$ is preferably a substituted hydrocarbon group such as an alkyl group having from 1 to 4 carbon atoms, a phenyl group, a vinyl group, a γ-glycidoxypropyl group, a γ-methacryloxypropyl group, a γ-aminopropyl group or 3,3,3-trifluoropropyl group, more preferably a methyl group or a phenyl group. In formula (III), a and b each is a number satisfying the relations described above. If a is less than 0.2 or b exceeds 3, there arises a problem of causing cracks on the cured coating of the coating material composition containing the silicone resin, which will be described later. If a is a number of from 2 to 4 or b is less than 0.0001, the curing cannot proceed successfully.

Silanol group-containing polyorganosiloxane (D) is not particularly limited, however, for example, one or a mixture of two or more selected from the group consisting of methyltrichlorosilane, dimethyldichlorosilane, phenyltrichlorosilane, diphenyldichlorosilane and their corresponding alkoxysilanes may be hydrolyzed with a large amount of water by a known method to obtain silanol group-containing polyorganosiloxane (D). When alkoxysilane is used and hydrolyzed by a known method for obtaining silanol group-containing polyorganosiloxane (D), a slight amount of alkoxy group sometimes remain not hydrolyzed. In other words, polyorganosiloxane where a silanol group and a very small amount of alkoxy group are present together, may be obtained, however, this polyorganosiloxane can be used in the present invention without any problem.

Component (E) contained in silicone resin (2), namely, curing catalyst (E), is a component of accelerating the condensation reaction of component (C) with component (D) and curing the coating of the coating material composition containing the silicone resin, which will be described later. Curing catalyst (E) is not particularly limited and examples thereof include alkyltitanates; carboxylic acid metal salts such as tin octylate, dibutyltin dilaurate and dioctyltin dimaleate; amine salts such as dibutylamine-2-hexoate, dimethylamine acetate and ethanolamine acetate; carboxylic acid quaternary ammonium salts such as acetic tetramethylammonium; amines such as tetraethylpentamine; amine-base silane coupling agents such as N-β-aminoethyl-γ-aminopropyltrimethoxysilane and N-β-aminoethyl-γ-aminopropylmethyldimethoxysilane; acids such as p-toluenesulfonic acid, phthalic acid and hydrochloric acid; aluminum compounds such as aluminum alkoxide and aluminum chelate; alkali metal salts such as lithium acetate, lithium formate, sodium formate, potassium phosphate and potassium hydroxide; titanium compounds such as tetraisopropyl titanate, tetrabutyl titanate and titanium tetraacetylacetonate; and halogenated silanes such as methyltrichlorosilane, dimethyldichlorosilane and trimethylmonochlorosilane. Other than these, any may be used if it is effective for the acceleration of the condensation reaction of component (C) with component (D).

In silicone resin (2), the blending ratios of component (C) and component (D) are such that component (C) is from 1 to 99 parts by weight and component (D) is from 99 to 1 part by weight (preferably component (C) is from 5 to 95 parts by weight and component (D) is from 95 to 5 parts by weight, more preferably component (C) is from 10 to 90 parts by weight and component (D) is from 90 to 10 parts by weight), per 100 parts by weight in total of component (C) and component (D). If component (C) is less than 1 part by weight (component (B) exceeds 99 parts by weight), the curability is inferior and the coating may fail in having sufficiently high hardness, whereas if component (C) exceeds 99 parts by weight (component (B) is less than 1 part by weight), the curability is unstable and good coating may not be obtained.

In silicone resin (2), the blending ratio of component (E) is from 0.0001 to 10 parts by weight (preferably from 0.0005 to 8 parts by weight, more preferably from 0.0007 to 5 parts by weight), per 100 parts by weight in total of component (C) and component (D). If the amount of component (E) blended is less than 0.0001 part by weight, the curability lowers and the coating may fail in having sufficiently high hardness, whereas if it exceeds 10 parts by weight, the cured coating may be reduced in the heat resistance or become excessively high in the hardness to generate cracks.

The silicone resin for use in the present invention preferably further contains component (F), namely, acrylic resin (F), so as not only to impart toughness to the cured coating of the coating material composition containing the silicone resin, which will be described later, but also to improve adhesion of the coating (this also applies to silicone resins (1) and (2) as preferred examples of the silicone resin).

Acrylic resin (F) has an effect of improving toughness of the cured coating of the coating material composition containing the silicone resin, which will be described later, and thereby the layer thickness can be increased while preventing generation of cracks. Further, acrylic resin (F) is taken into the polysiloxane condensation cross-linked product which becomes a three-dimensional skeleton of a transparent resin cured product constituting the cured coating of the coating material composition containing the silicone resin, which will be described later, to thereby acryl-modify the condensation cross-linked product. When the condensation cross-linked product is acryl-modified, adhesion of the cured coating is intensified.

The first (meth)acrylic ester as one of the constituent monomers of acrylic resin (F) is at least one of the esters where $R^7$ in formula (IV) is a substituted or unsubstituted monovalent hydrocarbon group having from 1 to 9 carbon atoms, for example, an alkyl group such as methyl, ethyl, n-propyl, i-propyl, n-butyl, i-butyl, sec-butyl, tert-butyl, pentyl, hexyl, heptyl and octyl; a cycloalkyl group such as cyclopentyl and cyclohexyl; an aralkyl group such as 2-phenylethyl, 2-phenylpropyl and 3-phenylpropyl; an aryl group such as phenyl and tolyl; a hydrocarbon halogenide such as chloromethyl, γ-chloropropyl and 3,3,3-trifluoropropyl; or a hydroxyhydrocarbon group such as 2-hydroxyethyl, may be used.

The second (meth)acrylic ester as another constituent monomer of acrylic resin (F) is at least one of the esters where $R^7$ in formula (IV) is at least one selected from the group consisting of an epoxy group, a glycidyl group and a hydrocarbon group containing at least either one of these (e.g., γ-glycidoxypropyl).

The third (meth)acrylic ester as still another constituent monomer of acrylic resin (F) is at least one of the esters where $R^7$ in formula (IV) is a hydrocarbon group containing an alkoxysilyl group and/or a halogenated silyl group, such as a trimethoxysilylpropyl group, a dimethoxymethylsilylpropyl group, a monomethoxydimethylsilylpropyl group, a triethoxysilylpropyl group, a diethoxymethylsilylpropyl group, an ethoxydimethylsilylpropyl group, a trichlorosilylpropyl group, a dichloromethylsilylpropyl group, a chlorodimethylsilylpropyl group, a chlorodimethoxysilyl propyl group or a dichloromethoxysilylpropyl group.

Acrylic resin (F) is a copolymer containing at least three kinds of (meth)acrylic esters in total, more specifically, at least one first (meth)acrylic ester, at least one second (meth) acrylic ester and at least one third (meth)acrylic ester. The copolymer may further contain one or more selected from the above-described first, second and third (meth)acrylic esters or may contain one or more selected from (meth) acrylic esters other than those described above.

The first (meth)acrylic ester is a component having an effect of imparting toughness to the cured coating of the coating material composition containing the silicone resin, which will be described later, and thereby adapting the cured coating for the deformation of the photoreceptor. The first (meth)acrylic ester further has an effect of improving the compatibility between component (C) and component (D) in silicone resin (2). In order to achieve these effects more successfully, the substituted or unsubstituted hydrocarbon group represented by $R^7$ preferably has a volume of a certain degree or more and preferably has 2 or more carbon atoms.

The second (meth)acrylic ester is a component having an effect of maintaining the adhesion between the cured coating of the coating material composition containing the silicone resin, which will be described later, and the backing material (which varies depending on the case, for example, a charge generating layer, a primer layer or a conductive substrate) for a long period of time.

The third (meth)acrylic ester is a component having an effect of forming a chemical bond between acrylic resin (F) and organosiloxane at the curing of the coating of the coating material composition containing the silicone resin, which will be described later, and thereby fixing acrylic resin (F) in the cured coating. Further, the third (meth)acrylic ester has an effect of improving the compatibility of acrylic resin (F) with component (B) in the coating material composition containing silicone resin (1), which will be described later, or the compatibility of acrylic resin (F) with component (C) and component (D) in the coating material composition containing silicone resin (2), which will be described later.

The molecular weight of acrylic resin (F) greatly affects the compatibility of acrylic resin (F) with component (B) or the compatibility of acrylic resin (F) with component (C) and component (D). If the weight-average molecular weight of acrylic resin (F), in terms of polystyrene, exceeds 50,000, phase separation occurs and the coating may be whitened. Accordingly, acrylic-resin (F) preferably has a weight-average molecular weight, in terms of polystyrene, of 50,000 or less. Further, the weight-average molecular weight of acrylic resin (F), in terms of polystyrene, preferably has a lower limit of 1,000. If the molecular weight is less than 1,000, the coating is reduced in the toughness and disadvantageously tends to have generation of cracks.

The second (meth)acrylic ester preferably has a monomer molar ratio of 2% or more in the copolymer as acrylic resin (F). If the ratio is less than 2%, the coating is liable to have insufficient adhesion.

The third (meth)acrylic ester preferably has a monomer molar ratio of from 2 to 50% in the copolymer as acrylic resin (F). If the ratio is less than 2%, the compatibility of acrylic resin (F) with component (B) in the coating material composition containing silicone resin (1) or the compatibility of acrylic resin (F) with component (C) and component (D) in the coating material composition containing silicone resin (2) is poor and the coating may be whitened. If the monomer molar ratio exceeds 50%, the bonding density of acrylic resin (F) to component (B) or the bonding density of acrylic resin (F) to component (C) and component (D) increases too high and the toughness which is an object originally intended to obtain by the use of acrylic resin (F), may not be obtained.

Acrylic resin (F) may be synthesized, for example, by the radical polymerization using solution polymerization, emulsion polymerization or suspension polymerization in a known organic solvent, or by the anionic polymerization or cationic polymerization, however, the synthesis method is by no means limited thereto.

In the radical polymerization using solution polymerization, for example, according to a known method, first, second and third (meth)acrylic ester monomers are dissolved in an organic solvent in a reaction vessel, a radial polymerization initiator is added, and the mixture is reacted under heating in a nitrogen stream. The organic solvent used here is not particularly limited and for example, toluene, xylene, ethyl acetate, butyl acetate, methyl ethyl ketone, methyl isobutyl ketone, ethylene glycol monobutyl ether, diethylene glycol monobutyl ether or acetic ethylene glycol monoethyl ether may be used. The radical polymerization initiator is also not particularly limited and for example, cumen hydroperoxide, tert-butyl hydroperoxide, dicumyl peroxide, di-tert-butyl peroxide, benzoyl peroxide, acetyl peroxide, lauroyl peroxide, azobisisobutyronitrile, hydrogen peroxide-$Fe^{2+}$ salt, persulfate-$NaHSO_3$, cumen hydroperoxide-$Fe^{2+}$ salt, benzoyl peroxide-dimethylaniline or peroxide-triethylaluminum may be used. In order to control the molecular weight, a chain transfer agent may be added. The chain transfer agent is not particularly limited and for example, quinones such as monoethylhydroquinone and p-benzoquinone; thiols such as mercaptoacetic acid-ethyl ester, mercaptoacetic acid-n-butyl ester, mercaptoacetic acid-2-ethylhexyl ester, mercaptocyclohexane, mercaptocyclopentane and 2-mercaptoethanol; thiophenols such as di-3-chlorobenzenethiol, p-toluenethiol and benzenethiol; thiol derivatives such as γ-mercaptopropyltrimethoxysilane; phenylpicrylhydrazine, diphenylamine; and tert-butyl catechol may be used.

In the case where the silicone resin contains acrylic resin (F), the blending ratio of acrylic resin (F) is not particularly limited, however, for example, it is blended in a ratio of preferably from 1 to 100 parts by weight, more preferably from 5 to 30 parts by weight, per 100 parts by weight of all silicone solid contents exclusive of component (A). The all silicon solid contents means, for example, when the silicone resin is silicone resin (1), the solid contents of organosiloxane (B) and when the silicone resin is silicone resin (2), the total solid contents of component (C) and component (D). If the amount of (F) blended is less than 1 part by weight, the toughness may be weakened, whereas if it exceeds 100 parts by weight, curing of the coating may be inhibited.

The electrophotographic photoreceptor of the present invention comprises a conductive substrate 10 having thereon a charge generating layer 11 and a charge transporting layer 12 in this order, as shown in FIG. 1.

The photoconductive material for use in the charge generating layer is not particularly limited and may be one conventionally used for the photoreceptor. Examples thereof include an organic dye or pigment such as phthalocyanine-base pigment, perylene-base pigment, bisazo-base pigment, cyanine dye and squarylium dye. The photoconductive materials may be used individually or in combination of two or more thereof.

The charge transporting material for use in the charge transporting layer is not particularly limited and may be one conventionally used for the photoreceptor. Examples thereof include a stilbene derivative, a hydrazone derivative, a triphenylamine derivative, a pyrazoline derivative and an oxazole derivative. The charge transporting materials may be used individually or in combination of two or more thereof.

Figure 2:
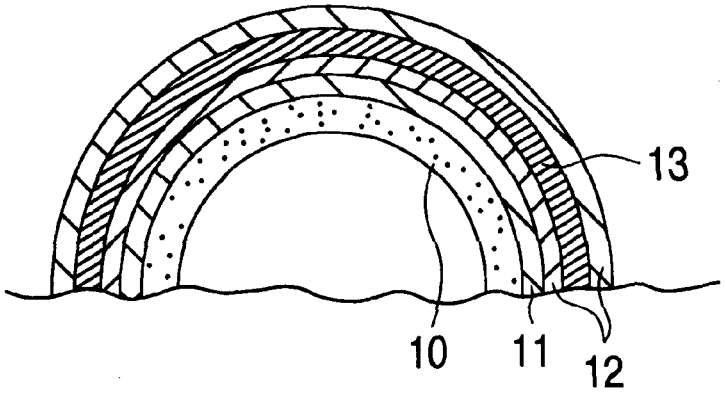
FIG. 2 is a sectional view showing another embodiment of an electrophotographic photoreceptor according to the present invention.

In the present invention, two or more charge transporting layers may be provided on the charge generating layer. In this case, linear polysiloxanediol (A) may only be contained in the layer furthermost from the conductive substrate. Further, as shown in FIG. 2, when the photoreceptor of the present invention has two or more charge transporting layers, an intermediate coat layer 13 may be provided between the charge transporting layers for improving adhesion. The intermediate coat layer is not particularly limited, however, for example, the layer comprises a transparent resin cured product of a coating material composition for forming an intermediate coat layer, containing 10 wt % or more of at least one resin selected from the group consisting of nylon resin, alkyd resin, epoxy resin, acrylic resin, acrylsilicone resin, rubber chloride resin, urethane resin, phenol resin, polyester resin and melamine resin.

In order to further improve adhesion or the like between the charge generating layer and the charge transporting layer, not only the transparent resin cured product of the charge transporting layer but also the transparent resin cured product of the charge generating layer are preferably a cured product of the above-described silicone resin. However, in the electrophotographic photoreceptor of the present invention, it is sufficient if out of the charge generating layer and the charge transporting layer, the transparent resin cured product of at least the outermost charge transporting layer is the silicone resin. The transparent resin cured product of the charge generating layer and the charge transporting layer other than the outermost layer is not limited to the cured product of the silicone resin but may be a transparent resin cured product conventionally used for the charge generating layer and the charge transporting layer of an electrophotographic photoreceptor. This transparent resin cured product is not particularly limited and for example, a cured product of resin such as polyvinylbutyral resin, acrylic resin, phenol resin, styrene polymer, styrene-butadiene copolymer, styrene-acrylic copolymer, polyester, polyamide, polyurethane, epoxy resin, polycarbonate, polyacrylate, polyvinyl chloride, polysulfone, polyether, polyacrylsilicone, or polyacrylurethane may be used.

The thickness of the charge generating layer is not particularly limited but, for example, it is preferably from 0.05 to 1 μm, more preferably from 0.1 to 0.8 μm. If the thickness is too small, a problem may be caused that injection of the carrier into the charge transporting layer is insufficient and a good image cannot be obtained, whereas if it is too large, there may arise a problem that the surface potential is conspicuously reduced.

The thickness of the charge transporting layer is not particularly limited and, for example, it is preferably from 1 to 50 μm, more preferably from 5 to 30 μm. If the thickness is too small, a problem may be caused that electrification is insufficient and a good image cannot be obtained, whereas if it is too large, there may arise a problem that generation of cracks is incurred to reduce the durability of the photoreceptor.

The photoreceptor of the present invention preferably further comprises, although not particularly limited, at least one intermediate coat layer comprising a transparent resin cured product between the charge generating layer and the charge transporting layer so that adhesion between the charge generating layer and the charge transporting layer can be improved. This effect of improving the adhesion is outstanding particularly when a cured product conventionally used for the charge generating layer of a photoreceptor is used as the transparent resin cured product of the charge generating layer. The intermediate coat layer is not particularly limited, however, for example, the layer comprises a transparent resin cured product of a coating material composition for forming an intermediate coat layer, containing 10 wt % or more of at least one resin selected from the group consisting of nylon resin, alkyd resin, epoxy resin, acrylic resin, acrylsilicone resin, rubber chloride resin, urethane resin, phenol resin, polyester resin and melamine resin. The thickness of the intermediate coat layer is not particularly limited, however, for example, it is preferably from 0.1 to 10 μm, more preferably from 0.5 to 3 μm. If the thickness is too small, the effect of improving adhesion cannot be obtained, whereas if it is too large, the charge transporting may be inhibited.

The photoreceptor of the present invention has a structure such that a charge generating layer and a charge transporting layer are laminated in this order on a conductive substrate and the shape of the conductive substrate may be any of drum, sheet and belt. The constructive material for the conductive substrate is not particularly limited as long as it has electrical conductivity and sufficiently high mechanical strength. Examples thereof include a metal single material such as iron, copper, aluminum, brass or stainless steel, a glass base material having formed thereon a film of the above-described metal or a metal oxide thereof by means of deposition or the like, and a plastic base material. The base material itself may have electrical conductivity or an electrically conductive layer may be formed on the surface of the base material.

Although not particularly limited, the conductive substrate is preferably one of which surface is previously covered with a primer layer (undercoat layer) (namely, a primer layer is further laminated between the conductive substrate and the charge generating layer) so as to improve adhesion between the conductive substrate and the charge generating layer. The primer layer may have an effect of electrically insulating the conductive substrate from the charge generating layer and the charge transporting layer. The primer layer is not particularly limited, however, examples thereof include a coating comprising a transparent resin cured product of a coating material composition for forming a primer layer, containing 10 wt % or more of at least one resin selected from the group consisting of nylon resin, alkyd resin, epoxy resin, acrylic resin, acrylsilicone resin, rubber chloride resin, urethane resin, phenol resin, polyester resin and melamine resin, and a metal oxide coating (e.g., alumite coating for protecting the surface of aluminum). The thickness of the primer layer is not particularly limited, however, it is preferably from 0.1 to 5 μm, more preferably from 0.5 to 3 μm. If the thickness is too small, the effect of improving adhesion cannot be obtained, whereas if it is too large, the charge transporting may be inhibited.

The production method of the photoreceptor for use in the present invention is not particularly limited, however, a method of coating in sequence a coating material composition for forming the charge generating layer and a coating material composition for forming the charge transporting layer on the surface of the conductive substrate and then curing the compositions may be used.

This method is described below.

The coating material composition for forming a charge generating layer contains a photoconductive material and a raw material resin (preferably the above-described silicone resin, more preferably silicone resin (1) or (2)) of the transparent resin cured product. The coating material composition for forming a charge transporting layer contains a charge transporting material and the above-described silicone resin (preferably silicone resin (1) or (2)).

The blending ratio of the photoconductive material in the coating material composition for forming the charge generating layer is not particularly limited, however, for example, it is preferably from 200 to 500 parts by weight, more preferably from 250 to 400 parts by weight, per 100 parts by weight of the raw material resin of the transparent resin cured product. If the ratio of the photoreceptor blended is less than the above-described range, a problem may be caused that injection of the carrier into the charge transporting layer is insufficient and a good image cannot be obtained, whereas if it exceeds the above-described range, there may arise a problem that the charge generating layer is disadvantageously low in the coating strength and troubles such as adhesion failure are incurred.

The ratio of the charge transporting material blended in the coating material composition for forming the charge transporting layer is not particularly limited, however, it is preferably from 30 to 130 parts by weight, more preferably from 50 to 100 parts by weight, per 100 parts by weight of the raw material resin of the transparent resin cured product. If the ratio of the charge carrier blended is less than the above-described range, a problem may be caused that injection of the carrier into the charge transporting layer is insufficient, whereas if it exceeds the above-described range, there may arise a problem that the charge transporting layer is reduced in the coating strength and the abrasion resistance lowers.

When a plurality of charge generating layers are present, for example, when a coating layer containing the silicone resin of the present invention is laminated on a conventional charge transporting layer, if the carrier can move without any problem, the silicone resin is not necessarily required to contain the charge transporting material.

A photoreceptor where the above-described primer layer is further laminated between the conductive substrate and the charge generating layer, may be obtained by adding a process of coating a coating material composition for forming the primer layer before coating the coating material composition for forming the charge generating layer and then curing the resulting coating.

A photoreceptor where the above-described intermediate coat layer is further laminated between the charge generating layer and the charge transporting layer, may be obtained by adding a process of coating a coating material composition for forming the intermediate coat layer after coating the coating material composition for forming the charge generating layer but before the coating of the coating material composition for forming the charge transporting layer, and then curing the resulting coating.

An electrophotographic photoreceptor comprising a plurality of charge generating layers may be obtained by coating the silicone resin coating material composition for forming the charge generating layer on the charge transporting layer of a conventional photoreceptor where a charge generating layer and a charge transporting layer are laminated in this order, and then curing the coating obtained.

An electrophotographic photoreceptor comprising a plurality of charge generating layers and further an intermediate coat layer laminated between the layers may be obtained by adding a process of coating a coating material for forming the intermediate coat layer after the formation of the conventional charge transporting layer but before the coating of the silicone resin coating material composition for forming the charge generating layer, and curing the coating obtained.

The method of coating each coating material composition is not particularly limited and may be selected from various usual coating methods such as brush coating, spray coating, dipping, roller coating, flow coating, curtain coating and knife coating.

Each coating material composition may be used after diluting it with various organic solvents, if desired, for facilitating the handling, or may be initially diluted with the organic solvent. The kind of the organic solvent can be appropriately selected according to the kind of the monovalent hydrocarbon group in respective components of the silicone resin or the size of the molecular weight in respective components of the silicone resin. The organic solvent is not particularly limited, however, for example, one or more selected from the group consisting of lower aliphatic alcohols such as methanol, ethanol, isopropanol, n-butanol and isobutanol; ethylene glycol derivatives such as ethylene glycol, ethylene glycol monobutyl ether and acetic ethylene glycol monoethyl ether; diethylene glycol derivatives such as diethylene glycol and diethylene glycol monobutyl ether; and toluene, xylene, hexane, heptane, ethyl acetate, butyl acetate, methyl ethyl ketone, methyl isobutyl ketone, methyl ethyl ketoxime and diacetone alcohol, may be used. The dilution ratio with the organic solvent is not particularly limited and the dilution ratio may be appropriately determined according to the necessity.

Each coating material composition may contain additives such as a thickener, a coupling agent and a levelling agent, if desired, within the range of not adversely affecting the effect of the present invention.

The curing method of the coating of each coating material composition is not particularly limited and a known method may be used. Further, the temperature at the curing is also not particularly limited. In particular, for the coating material composition containing the above-described silicone resin, the temperature may be selected from a wide range of from ordinary temperature to the heating temperature according to the desired performance of the cured coating, the presence or absence of a curing catalyst, or the heat resistance of the photoreceptor and the charge transporting material.

EXAMPLES

The present invention is described in greater detail below by referring to the Examples and Comparative Examples. Unless otherwise indicated, the "parts" and "%" in the Examples and Comparative Examples all are "parts by weight" and "% by weight (wt %)", respectively. The molecular weight is determined by GPC (gel permeation chromatography) as a conversion value from the calibration curve of standard polystyrene configured using a measurement device Model HLC8020 manufactured by Tosoh Corporation. The present invention should not be construed as being limited to the Examples.

Respective components for use in the Examples and Comparative Examples were prepared as follows.

(Component A):

<A-1>

Linear dimethylpolysiloxanediol having a weight-average molecular weight (Mw) of 800, where n in formula (I) is about 11 (average) and $R^1$ is a methyl group. This was designated as A-1.

<A-2>

Linear dimethylpolysiloxanediol having a weight-average molecular weight (Mw) of 3,000, where n in formula (I) is about 40 (average) and $R^1$ is a methyl group. This was designated as A-2.

<A-3>

Linear methylphenylpolysiloxanediol having a weight-average molecular weight (Mw) of 450, where n in formula (I) is about 4 (average) and $R^1$ is a methyl group and a phenyl group. This was designated as A-3.

<A-4>

Linear dimethylpolysiloxanediol having a weight-average molecular weight (Mw) of 7,000, where n in formula (I) is about 90 (average) and $R^1$ is a methyl group. This was designated as A-4.

Preparation Example of Component B

Preparation Example B-1

To 100 parts of methyltrimethoxysilane as raw material ($B_1$), 90 parts of IPA organosilica sol [trade name "OSCAL 1432", produced by Catalysts & Chemicals Ind. Co., Ltd. (CCIC), solid contents: 30%], which is an acidic colloidal silica, as raw material ($B_2$) was mixed. The mixture was diluted with 100 parts of IPA and 37.7 parts of water was added thereto, followed by stirring. The solution obtained was heated in a thermostat at 60° C. for 5 hours to adjust the weight-average molecular weight Mw to 1,500, thereby obtaining an organosiloxane 23% alcohol solution. This solution was designated as B-1.

Preparation Conditions of B-1:

| | |
|---|---|
| Molar ratio [water]/[$OR^2$] | 0.95 |
| Weight-average molecular weight | 1,500 |
| Solid contents | 23% |

Preparation Example B-2

To 100 parts of methyltrimethoxysilane as raw material ($B_1$), 60 parts of IPA organosilica sol [trade name "OSCAL 1432", produced by CCIC, solid contents: 30%], which is an acidic colloidal silica, as raw material ($B_2$) and 30 parts of dimethyldimethoxysilane as raw material ($B_3$) were mixed. The mixture was diluted with 100 parts of isopropyl alcohol (hereinafter simply referred to as "IPA") and 39 parts of water was added thereto, followed by stirring. The solution obtained was heated in a thermostat at 60° C. for 5 hours to adjust the weight-average molecular weight Mw to 1,200, thereby obtaining an organosiloxane 26% alcohol solution. This solution was designated as B-2.

Preparation Conditions of B-2:

| | |
|---|---|
| Molar ratio [water]/[$OR^2$] | 1.15 |
| Weight-average molecular weight | 1,200 |
| Solid contents | 26% |

Preparation Example B-3

To 100 parts of methyltrimethoxysilane as raw material ($B_1$), 20 parts of IPA organosilica sol [trade name "OSCAL 1432", produced by CCIC, solid contents: 30%], which is an acidic colloidal silica, as raw material ($B_2$) and 60 parts of dimethyldimethoxysilane as raw material ($B_3$) were mixed. The mixture was diluted with 131 parts of isopropyl alcohol (hereinafter simply referred to as "IPA") and 58 parts of water was added thereto, followed by stirring. The solution obtained was heated in a thermostat at 60° C. for 5 hours to adjust the weight-average molecular weight Mw to 1,300, thereby obtaining an organosiloxane 25% alcohol solution. This solution was designated as B-3.

Preparation Conditions of B-3:

| | |
|---|---|
| Molar ratio [water]/[$OR^2$] | 1.0 |
| Weight-average molecular weight | 1,300 |
| Solid contents | 25% |

Preparation Example of Component C

Preparation Example C-1

Into a flask with a stirrer, a heating jacket, a condenser and a thermometer, 100 parts of IPA dispersion colloidal silica sol IPA-ST (particle size: 10 to 20 nm, solid contents: 30%, water content: 0.5%, produced by Nissan Chemical Industries, Ltd.), 68 parts of methyltrimethoxysilane and 10.8 parts of water were charged. The mixture was stirred at 65° C. for about 5 hours to effect partial hydrolysis reaction and then the reaction solution was cooled to obtain Component (C-1). This was left standing at room temperature for 48 hours and then the solid contents was 36%.

Preparation Conditions of C-1:

| | |
|---|---|
| Molar number of water per 1 molar equivalent of hydrolyzable group | 0.4 mol |
| Silica content of Component (C-1) | 47.3% |
| Mol % of hydrolyzable organosilane where m is 1 | 100 mol % |

Preparation Example C-2

Into a flask with a stirrer, a heating jacket, a condenser and a thermometer, 100 parts of xylene.n-butanol mixed solvent dispersion colloidal silica sol XBA-ST (particle size: 10 to 20 nm, solid contents: 30%, water content: 0.2%, produced by Nissan Chemical Industries, Ltd.) and 68 parts of methyltrimethoxysilane were charged. The mixture was stirred at 65° C. for about 5 hours to effect partial hydrolysis reaction and then the reaction solution was cooled to obtain Component (C-2). This was left standing at room temperature for 48 hours and then the solid contents was 36%.

Preparation Conditions of C-2:

| | |
|---|---|
| Molar number of water per 1 molar equivalent of hydrolyzable group | 0.007 mol |
| Silica content of Component (C-2) | 47.3% |
| Mol % of hydrolyzable organosilane where m is 1 | 100 mol % |

Preparation Example of Component D

Preparation Example D-1

Into a flask equipped with a stirrer, a heating jacket, a condenser, a dropping funnel and a thermometer, a solution containing 220 parts (1 mol) of methyltriisopropoxysilane dissolved in 150 parts of toluene was charged. Thereto, 108 parts of a 1% aqueous hydrochloric acid solution was added dropwise over 20 minutes and methyltriisopropoxysilane was hydrolyzed at 60° C. while stirring. 40 minutes after completion of the dropwise addition, the stirring was stopped and the reaction solution was transferred into a separating funnel and left standing. Then the solution separated into two phases. The mixed solution of water and isopropyl alcohol containing a slight amount of hydrochloric acid in the lower layer was separated and removed, and hydrochloric acid remaining in the residual resin solution of toluene was removed by water washing. Further, toluene was removed under reduced pressure and the residue was diluted with isopropyl alcohol to obtain an isopropyl alcohol 40% solution of silanol group-containing polyorganosiloxane having a weight-average molecular weight (Mw) of about 2,000. This was designated as D-1. The silanol group-containing polyorganosiloxane in D-1 was verified to satisfy average composition formula (III) described above.

Preparation Example D-2

Into a flask equipped with a stirrer, a heating jacket, a condenser, a dropping funnel and a thermometer, 1,000 parts of water and 50 parts of acetone were charged. Thereto, a solution containing 44.8 parts (0.3 mol) of methyltrichlorosilane, 38.7 parts (0.3 mol) of dimethyldichlorosilane and 84.6 parts (0.4 mol) of phenyltrichlorosilane dissolved in 200 parts of toluene was added dropwise while stirring to effect hydrolysis at 60° C. 40 minutes after completion of the dropwise addition, the stirring was stopped and the reaction solution was transferred into a separating funnel and left standing. Then the solution separated into two phases. The hydrochloric acid solution in the lower layer was separated and removed, and water and hydrochloric acid remaining in the residual toluene solution of organopolysiloxane were removed by stripping under reduced pressure together with excessive toluene to obtain a toluene 60% solution of silanol group-containing polyorganosiloxane having a weight-average molecular weight (Mw) of about 3,000. This was designated as D-2. The silanol group-containing polyorganosiloxane in D-2 was verified to satisfy average composition formula (III) described above.

(Component E (curing catalyst)):

<E-1>

N-β-Aminoethyl-γ-aminopropylmethyldimethoxysilane. This was designated as E-1.

Preparation Example of Component F

Preparation Example F-1

In a flask equipped with a stirrer, a heating jacket, a condenser, a dropping funnel, a nitrogen gas inlet/outlet and a thermometer, a solution containing 0.025 part of azobisisobutyronitrile dissolved in 3 parts of toluene was added dropwise to a reaction solution containing 5.69 parts of n-butyl methacrylate (BMA), 1.24 parts of trimethoxysilylpropyl methacrylate (SMA), 0.71 part of glycidyl methacrylate (GMA) and 0.784 part of γ-mercaptopropyltrimethoxysilane as a chain transfer agent, in a nitrogen stream. The mixture was reacted at 70° C. for 2 hours and as a result, a 40% toluene solution of an acrylic resin having a weight-average molecular weight (MW) of 1,000 was obtained. This was designated as F-1.

Preparation Conditions of F-1:

| | |
|---|---|
| Monomer molar ratio BMA/SMA/GMA: | 8/1/1 |
| Weight-average molecular weight: | 1,000 |
| Solid contents: | 40% |

Using respective components obtained above, silicone resins were prepared as follows.

[Preparation of Silicone Resin (1)]:

Preparation Examples 1-1 and 1-2

Components shown in Table 1 were mixed at a ratio shown in the same Table to obtain Silicone Resins (1-1) and (1-2).

Comparative Preparation Example 1-3

Potassium acetate as a curing catalyst was added to the organosiloxane 26% alcohol solution (B-2) prepared in Preparation Example B-2, in an amount shown in Table 1 to obtain Silicone Resin (1-3).

[Preparation of Silicone Resin (2)]:

Preparation Examples 2-1 to 2-4 and Comparative Preparation Examples 2-5 and 2-6

Components shown in Table 1 were mixed at a ratio shown in the same Tables to obtain Silicone Resins (2-1) to (2-6).

The ratio in number of the trifunctional silicon unit or the tetrafunctional silicon unit based on all silicon units in each silicone resin obtained above was calculated from the amount of raw material monomers charged, taking the conversion as 100%. The results obtained are shown in Table 2.

The proportion (wt %) of component (A) to all silicone solids contents exclusive of component (A) is shown in Table 1.

Using the silicone resins obtained, the following Examples were performed.

Example 1

On the circumferential surface of an SUS304-made pipe (30 mmϕ×253 mmL×0.4 mmt) used as a conductive substrate, a primer composition comprising a solution of type 8 nylon resin (trade name "Toresin F", produced by Teikoku Kagaku KK) (solvent: a 1/3 (by weight) mixed solvent of methanol and butanol, resin solid contents: 25%) was coated by the dip coating, and the coating was cured at 80° C. for 1 hour to cover the circumferential surface of the conductive substrate with a primer layer having a thickness of 1 μm.

Then, a coating material composition prepared by dispersing a photoconductive material comprising an X-type metal-free phthalocyanine in a binder comprising a polyvinyl butyral resin (trade name "S-Lec BM1", produced by Sekisui Chemical Co., Ltd.) (resin solid contents: 10%) (weight ratio of photoreceptor to binder: 3/1) was coated on the surface of the primer layer formed above by the dip coating, and the coating was cured at 60° C. for 2 hours to form a charge generating layer having a thickness of 0.3 μm.

Then, a commercially available acryl silicone resin (trade name "Alco sp", produced by Natoco Paint Co., Ltd.) was coated on the surface of the charge generating layer by the dip coating method and the coating was cured at 60° C. for 30 minutes to form an intermediate coat layer having a thickness of 0.5 μm on the surface o the charge generating layer.

Thereafter, a coating material composition comprising a 36/64 (by weight) mixture of a charge transporting material comprising N,N'-diphenyl-N,N'-bis(m-tolyl)benzidine and a binder comprising Silicone Resin (1-1) obtained in Preparation Example 1-1 was coated on the surface of the intermediate coat layer formed above by the spray coating, and the coating was cured at 60° C. for 2 hours to form a charge transporting layer having a thickness of 20 μm on the surface of the intermediate coat layer. Thus, a photosensitive drum comprising a single charge transporting layer was obtained.

Examples 2 to 10 and Comparative Examples 1 to 4

Photosensitive drums each comprising a single charge transporting layer of respective Examples and Comparative Examples were obtained in the same manner as in Example 1 except for changing the constructive material of the conductive substrate, the use of a primer layer, the kind of binders in the charge generating layer and the charge transporting layer and the presence or absence of the intermediate coat layer between the charge generating layer and the charge transporting layer, of Example 1 as shown in Table 2.

Example 11

A photosensitive drum having a single charge transporting layer was obtained by forming a primer layer, a charge generating layer and a first charge transporting layer on the SUS304 pipe in this order as shown in Table 2 through the same operation as in Example 1. In this photosensitive drum, a commercially available acryl silicone resin (trade name "Alco sp", produced by Natoco Paint Co., Ltd.) was coated on the surface of the first charge transporting layer by the dip coating method and the coating was cured at 60° C. for 30 minutes to form an intermediate coat layer having a thickness of 0.5 μm on the surface o the first charge transporting layer.

Then, a coating material composition comprising Silicone Resin (1-2) obtained in Preparation Example 1-2 and not containing a charge transporting material in particular was coated on the surface of the intermediate coat layer formed above by the dip coating and the coating was cured at 60° C. for 2 hours to form a second charge transporting layer having a thickness of 2 μm on the surface of the intermediate coat layer, thereby obtaining a photosensitive drum having a plurality of charge transporting layers.

Examples 12 and 13 and Comparative Example 5

Photosensitive drums according to the invention and for comparison each having a plurality of charge transporting layers were obtained through the same operation as in Example 11 except for changing the presence or absence of the intermediate coat layer between the first charge transporting layer and the second charge transporting layer and the kind of the coating material for the second charge transporting layer of Example 11 as shown in Table 2.

Comparative Example 6

A photosensitive drum was tried to prepare using a commercially available silicone rubber as the binder of the charge transporting layer, however, since the silicone rubber had no transparency, a photosensitive drum could not be obtained.

The thus-obtained photosensitive drums were evaluated on the abrasion resistance, the stain resistance (toner releasability) and the corona resistance according to the following method.

Each photosensitive drum was installed into a copying machine equipped with a charging device by corona discharge, an image writing device by a semiconductor laser, a one-part toner developing device, a transfer device and a cleaning device with a urethane rubber blade, and tested on the copying of 10,000 or 50,000 sheets.

After completion of the copying, the appearance of the photoreceptor surface was observed and the toner adhesion was evaluated based on the following criteria.

A: No adhesion of toner on the surface of photoreceptor.

B: Several lines of toner adhered to the surface.

C: Toner adhered throughout the surface.

When rated "B" or "C" in the above, the toner adhering to the surface of the photoreceptor was wiped off with a cotton cloth and the toner releasability was evaluated based on the following criteria.

A: Toner adhered could be cleanly wiped off.

B: Toner adhered partly remained.

C: Toner was embedded throughout the surface of photoreceptor and could be scarcely removed.

In the copying test of 10,000 sheets, any photosensitive drum was free of printing troubles and a good image could be obtained. Further, cracks or peeling was also not observed.

On the other hand, in the copying test of 50,000 sheets, the photosensitive drums of Examples 1 to 13 were free of printing troubles and a good image could be obtained. The photosensitive drum of Comparative Example 1 underwent blurring of letters and thinning throughout the surface. The photosensitive drums of Comparative Examples 2 to 5 underwent blurring of letters.

The results of evaluation of the toner releasability are shown in Table 2.

TABLE 1

| | Solid Contents | Silicone Resin | | | | | | | | |
|---|---|---|---|---|---|---|---|---|---|---|
| | (%) | 1-1 | 1-2 | 1-3 | 2-1 | 2-2 | 2-3 | 2-4 | 2-5 | 2-6 |
| Blending of respective components (parts) | | | | | | | | | | |
| A-1 | 100 | 5 | 20 | — | 10 | 30 | 10 | 30 | — | — |
| A-2 | 100 | — | — | — | 2 | — | — | — | — | — |
| A-3 | 100 | — | — | — | — | — | — | — | — | — |
| A-4 | 100 | — | — | — | — | — | — | 10 | — | — |
| B-1 | 23 | 100 | — | — | — | — | — | — | — | — |
| B-2 | 26 | — | — | 100 | — | — | — | — | — | — |
| B-3 | 25 | — | 100 | — | — | — | — | — | — | |
| C-1 | 36 | — | — | — | — | — | 70 | — | 70 | 70 |
| C-2 | 36 | — | — | — | 60 | 60 | — | 60 | — | — |
| D-1 | 40 | — | — | — | — | — | 30 | — | 30 | 30 |
| D-2 | 60 | — | — | — | 40 | 40 | — | 40 | — | — |
| E-1 | 100 | — | — | — | 2 | 3 | 2 | — | 1 | 2 |

TABLE 1-continued

| | Solid Contents | Silicone Resin | | | | | | | | |
|---|---|---|---|---|---|---|---|---|---|---|
| | (%) | 1-1 | 1-2 | 1-3 | 2-1 | 2-2 | 2-3 | 2-4 | 2-5 | 2-6 |
| F-1 | 40 | — | — | — | — | 20 | — | — | — | 20 |
| potassium acetate | 100 | 1 | 1 | 1 | — | — | — | — | — | — |
| Ratio of silicon unit (%)* | | | | | | | | | | |
| trifunctional | | 52 | 31 | 57 | 45 | 34 | 46 | 30 | 66 | 67 |
| tetrafunctional | | 32 | 4 | 23 | 22 | 16 | 24 | 15 | 34 | 32 |
| Ratio of component (A) (wt %)** | | 19 | 80 | 0 | 26 | 66 | 54 | 88 | 0 | 0 |

*: Ratio to the number of all silicon units
**: Ratio to all silicone resin exclusive of component (A)

TABLE 2

| | Example 1 | Example 2 | Example 3 |
|---|---|---|---|
| Conductive Substrate | SUS304 pipe | SUS304 pipe | SUS304 pipe |
| Primer Layer | 8-nylon | 8-nylon | 8-nylon |
| Charge Generating Layer | | | |
| Binder | polyvinyl-butyral | polyvinyl butyral | polyvinyl butyral |
| Photoconductive Material | X-type metal-free phthalo-cyanine | X-type metal-free phthalo-cyanine | X-type metal-free phthalo-cyanine |
| Intermediate Layer*1 | commer-cially available acryl-silicone | — | commer-cially available acryl-silicone |
| Charge Transporting Layer | | | |
| Binder | silicone resin (1-1) | silicone resin (1-2) | silicone resin (2-1) |
| Charge Transporting Material | N,N'-diphenyl-bis(m-tolyl)-benzidine | N,N'-diphenyl-bis(m-tolyl)-benzidine | N,N'-diphenyl-bis(m-tolyl)-benzidine |
| Intermediate Layer*2 | — | — | — |
| Overcoat Layer*3 | — | — | — |
| 10,000 sheets copying | | | |
| Toner Adhesion | B | A | A |
| Toner Releasability | A | — | — |
| 50,000 sheets copying | | | |
| Toner Adhesion | B | B | A |
| Toner Releasability | A | A | — |
| | Example 4 | Example 5 | Example 6 |
| Conductive Substrate | SUS304 pipe | SUS304 pipe | SUS304 pipe |
| Primer Layer | 8-nylon | 8-nylon | 8-nylon |
| Charge Generating Layer | | | |
| Binder | polyvinyl butyral | polyvinyl butyral | polyvinyl butyral |
| Photoconductive Material | X-type metal-free phthalo-cyanine | X-type metal-free phthalo-cyanine | X-type metal-free phthalo-cyanine |
| Intermediate Layer*1 | — | — | — |
| Charge Transporting Layer | | | |
| Binder | silicone resin (2–2) | silicone resin (2–3) | silicone resin (2–4) |
| Charge Transporting Material | N,N'-diphenyl-bis(m-tolyl)-benzidine | N,N'-diphenyl-bis(m-tolyl)-benzidine | N,N'-diphenyl-bis(m-tolyl)-benzidine |
| Intermediate Layer*2 | — | — | — |
| Overcoat Layer*3 | — | — | — |
| 10,000 sheets copying | | | |
| Toner Adhesion | A | B | A |
| Toner Releasability | — | A | — |
| 50,000 sheets copying | | | |
| Toner Adhesion | A | B | A |
| Toner Releasability | — | A | — |
| | Example 7 | Example 8 | Example 9 |
| Conductive Substrate | SUS304 pipe | aluminum pipe | aluminum pipe |
| Primer Layer | 8-nylon | alumite | alumite |
| Charge Generating Layer | | | |
| Binder | silicone resin (2–2) | silicone resin (2–5) | silicone resin (1–3) |
| Photoconductive Material | X-type metal-free phthalo-cyanine | X-type metal-free phthalo-cyanine | X-type metal-free phthalo-cyanine |
| Intermediate Layer*1 | — | — | — |
| Charge Transporting Layer | | | |
| Binder | silicone resin | silicone resin | silicone resin |
| Charge Transporting Material | N,N'-diphenyl-N,N'-bis(m-tolyl)-benzidine | N,N'-diphenyl-N,N'-bis(m-tolyl)-benzidine | N,N'-diphenyl-N,N'-bis(m-tolyl)-benzidine |
| Intermediate Layer*2 | — | — | — |
| Overcoat Layer*3 | — | — | — |
| 10,000 sheets copying | | | |
| Toner Adhesion | A | A | B |
| Toner Releasability | — | — | A |
| 50,000 sheets copying | | | |
| Toner Adhesion | A | A | B |
| Toner Releasability | — | — | A |
| | Example 10 | Example 11 | Example 12 |
| Conductive Substrate | aluminum pipe | SUS304 pipe | SUS304 pipe |
| Primer Layer | alumite | 8-nylon | 8-nylon |
| Charge Generating Layer | | | |

TABLE 2-continued

| | Example 1 | Example 2 | Example 3 |
|---|---|---|---|
| Binder | polyvinyl butyral | polyvinyl butyral | polyvinyl butyral |
| Photoconductive Material | X-type metal-free phthalo-cyanine | X-type metal-free phthalo-cyanine | X-type metal-free phthalo-cyanine |
| Intermediate Layer*1 | — | — | — |
| Charge Transporting Layer | | | |
| Binder | silicone resin (2–1) | poly-carbonate Z | poly-carbonate Z |
| Charge Transporting Material | N,N'-diphenyl-N,N'-bis(m-tolyl)-benzidine | N,N'-diphenyl-N,N'-bis(m-tolyl)-benzidine | N,N'-diphenyl-N,N'-bis(m-tolyl)-benzidine |
| Intermediate Layer*2 | — | commer-cially available acryl-silicone | — |
| Overcoat Layer*3 | — | silicone resin (1–2) | silicone resin (2–2) |
| 10,000 sheets copying | | | |
| Toner Adhesion | A | A | A |
| Toner Releasability | — | — | — |
| 50,000 sheets copying | | | |
| Toner Adhesion | A | A | A |
| Toner Releasability | — | — | — |

| | Example 13 | Comparative Example 1 | Comparative Example 2 |
|---|---|---|---|
| Conductive Substrate | SUS304 pipe | SUS304 pipe | SUS304 pipe |
| Primer Layer | 8-nylon | 8-nylon | 8-nylon |
| Charge Generating Layer | | | |
| Binder | polyvinyl butyral | polyvinyl butyral | polyvinyl butyral |
| Photoconductive Material | X-type metal-free phthalo-cyanine | X-type metal-free phthalo-cyanine | X-type metal-free phthalo-cyanine |
| Intermediate Layer*1 | — | — | — |
| Charge Transporting Layer | | | |
| Binder | poly-carbonate Z | poly-carbonate Z | silicone resin (1–3) |
| Charge Transporting Material | N,N'-diphenyl-N,N'-bis(m-tolyl)-benzidine | N,N'-diphenyl-N,N'-bis(m-tolyl)-benzidine | N,N'-diphenyl-N,N'-bis(m-tolyl)-benzidine |
| Intermediate Layer*2 | commer-cially available acryl-silicone | — | — |
| Overcoat Layer*3 | silicone resin (2–1) | — | — |
| 10,000 sheets copying | | | |
| Toner Adhesion | A | C | B |
| Toner Releasability | — | B | A |
| 50,000 sheets copying | | | |
| Toner Adhesion | A | C | C |
| Toner Releasability | — | C | B |

TABLE 2-continued

| | Example 1 | Example 2 | Example 3 |
|---|---|---|---|
| | Comparative Example 3 | Comparative Example 4 | Comparative Example 5 |
| Conductive Substrate | SUS304 pipe | SUS304 pipe | SUS304 pipe |
| Primer Layer | 8-nylon | 8-nylon | 8-nylon |
| Charge Generating Layer | | | |
| Binder | polyvinyl butyral | polyvinyl butyral | polyvinyl butyral |
| Photoconductive Material | X-type metal-free phthalo-cyanine | X-type metal-free phthalo-cyanine | X-type metal-free phthalo-cyanine |
| Intermediate Layer*1 | — | — | — |
| Charge Transporting Layer | | | |
| Binder | silicone resin (2–5) | silicone resin (2–6) | poly-carbonate Z |
| Charge Transporting Material | N,N'-diphenyl-N,N'-bis(m-tolyl)-benzidine | N,N'-diphenyl-N,N'-bis(m-tolyl)-benzidine | N,N'-diphenyl-N,N'-bis(m-tolyl)-benzidine |
| Intermediate Layer*2 | — | — | commer-cially available acryl-silicone |
| Overcoat Layer*3 | — | — | silicone resin (2–5) |
| 10,000 sheets copying | | | |
| Toner Adhesion | B | B | B |
| Toner Releasability | A | A | A |
| 50,000 sheets copying | | | |
| Toner Adhesion | C | C | C |
| Toner Releasability | B | B | B |

In Table 2,
*1positioned between charge generating layer and charge transporting layer
*2positioned between charge transporting layers
*3the outermost charge transporting layer The silicone resin for use in the present invention can form a cured coating being excellent in abrasion resistance, stain resistance (toner releasability) and corona resistance. Accordingly, the photoreceptor of the present invention using the silicone resin as a binder at least of the outermost charge transporting layer out of the charge generating layer, has a charge transporting layer excellent in abrasion resistance, stain resistance (toner releasability), corona resistance and the like. Due to this, the photoreceptor is advantageous in the following points as compared with conventional photoreceptors.

1) The toner releasability (stain resistance) of the outermost charge transporting layer is high and therefore, toner hardly attaches to the surface of the charge transporting layer. Even if toner attaches to the surface, it can be easily removed with a cotton cloth or the like.

2) The outermost charge transporting layer has excellent abrasion resistance and therefore, the surface does not readily deteriorate due to friction against a cleaning blade or the like.

3) When the photoreceptor is charged by corona discharge, the surface is scarcely deteriorated by the corona discharge.

4) Due to the advantages of 1) to 3), the photoreceptor has a long life and it is not necessary to exchange the photoreceptor frequently.

When the silicone resin capable of forming an excellent cured coating is used not only as the binder of the charge transporting layer but also as the binder of the charge generating layer, in addition to the above-described advantages, the adhesion between the charge transporting layer and the charge generating layer is further improved.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive substrate having thereon a charge generating layer containing a photoconductive material in a transparent resin cured product and at least one charge transporting layer containing a charge transporting material in a transparent resin cured product in this order, wherein the transparent resin cured product in the outermost layer of said at least one charge transporting layer is a cured product of silicone resin and contains a linear polysiloxanediol (A) represented by the following general formula (I):

$$HO(R^1{}_2SiO)_nH \quad (I)$$

wherein $R^1$ represents a monovalent hydrocarbon group and the $R^1$ groups may be the same or different, and n is an integer of 3 or more, in an amount of 1 to 100 parts per 100 parts by weight of all silicone solids contents exclusive of component (A).

2. The electrophotographic photoreceptor as claimed in claim 1, wherein said silicone resin further comprises the following component (B):

Component (B):

an organosiloxane as a hydrolytic polycondensate of a hydrolyzable mixture containing from 20 to 200 parts by weight of a silicon compound represented by the formula: $Si(OR^2)_4$, and/or colloidal silica, per 100 parts by weight of a silicon compound represented by the formula: $R^3Si(OR^2)_3$, wherein $R^2$ and $R^3$ each represents a monovalent hydrocarbon group, said hydrolytic polycondensate being adjusted to have a weight-average molecular weight of 800 or more in terms of polystyrene.

3. The electrophotographic photoreceptor as claimed in claim 2, wherein said hydrolyzable mixture further contains 60 parts by weight or less of a silicon compound represented by the formula: $R^3{}_2Si(OR^2)_2$, wherein $R^2$ and $R^3$ each represents a monovalent hydrocarbon group, per 100 parts by weight of the silicon compound represented by the formula: $R^3Si(OR^2)_3$.

4. The electrophotographic photoreceptor as claimed in claim 1, wherein said silicone resin further comprises the following components (C), (D) and (E) in a blending ratio such that component (C) is from 1 to 99 parts by weight, component (D) is from 1 to 99 parts by weight and component (E) is from 0.0001 to 10 parts by weight, per 100 parts by weight in total of components (C) and (D):

Component (C):

a silica dispersed oligomer solution of organosilane, obtained by hydrolyzing a hydrolyzable organosilane represented by the formula:

$$R^4{}_mSiX_{4-m} \quad (II)$$

wherein $R^4$ represents a substituted or unsubstituted monovalent hydrocarbon group having from 1 to 8 carbon atoms and the $R^4$ groups may be the same or different, m represents an integer of from 0 to 3, and X represents a hydrolyzable group, in colloidal silica dispersed in an organic solvent, water or a mixed solvent thereof under the condition of using from 0.001 to 0.5 mol of water per 1 molar equivalent of said hydrolyzable group (X);

Component (D):

a polyorganosiloxane represented by the average composition formula:

$$R^5{}_aSi(OH)_bO_{(4-a-b)/2} \quad (III)$$

wherein $R^5$ represents a substituted or unsubstituted monovalent hydrocarbon group having from 1 to 8 carbon atoms and the $R^5$ groups may be the same or different, and a and b each represents a number satisfying the relations of $0.2 \leqq a < 2$, $0.0001 \leqq b \leqq 3$ and $a+b<4$, and containing a silanol group in the molecule; and Component (E):

a curing catalyst.

5. The electrophotographic photoreceptor as claimed in claim 1, wherein in formula (I) for said linear polysiloxanediol, n is in the range of $10 \leqq n \leqq 50$.

6. The electrophotographic photoreceptor as claimed in claim 1, wherein said silicone resin further comprises the following component (F) in a blending ratio of from 1 to 100 parts by weight per 100 parts by weight of all silicone solids contents exclusive of component (A):

Component (F):

a monomer represented by the formula:

$$CH_2{=}CR^6(COOR^7) \quad (IV)$$

wherein $R^6$ represents a hydrogen atom and/or a methyl group, which is an acrylic resin as a copolymer of:

a first (meth)acrylic ester where $R^7$ is a substituted or unsubstituted monovalent hydrocarbon group having from 1 to 9 carbon atoms;

a second (meth)acrylic ester where $R^7$ is at least one group selected from the group consisting of an epoxy group, a glycidyl group and a hydrocarbon group containing at least either one of these; and a third (meth)acrylic ester where $R^7$ is a hydrocarbon group containing an alkoxysilyl group and/or a halogenated silyl group.

7. The electrophotographic photoreceptor as claimed in claim 1, wherein at least one intermediate coat layer comprising a transparent resin cured product is laminated between said charge generating layer and said charge transporting layer.

8. The electrophotographic photoreceptor as claimed in claim 1, wherein said charge transporting layer has two or more layer and at least one intermediate coat layer comprising a transparent resin cured product is laminated between said charge transporting layers.

* * * * *